US008777019B2

(12) United States Patent
Dovell

(10) Patent No.: US 8,777,019 B2
(45) Date of Patent: Jul. 15, 2014

(54) SECURE STOW GO WINE RACK

(76) Inventor: Amy L. Dovell, Las Vegas, NV (US)

( * ) Notice: Subject to any disclaimer, the term of this patent is extended or adjusted under 35 U.S.C. 154(b) by 0 days.

(21) Appl. No.: 13/400,201

(22) Filed: Feb. 20, 2012

(65) Prior Publication Data

US 2012/0211452 A1 Aug. 23, 2012

Related U.S. Application Data

(60) Provisional application No. 61/463,647, filed on Feb. 22, 2011.

(51) Int. Cl.

| | |
|---|---|
| ***A47B 73/00*** | (2006.01) |
| ***A47F 7/00*** | (2006.01) |
| ***A47F 7/28*** | (2006.01) |
| ***B65D 71/52*** | (2006.01) |
| ***B65D 71/54*** | (2006.01) |
| ***B65D 25/28*** | (2006.01) |

(52) U.S. Cl.

CPC . *A47B 73/00* (2013.01); *A47F 7/28* (2013.01); *B65D 71/0003* (2013.01); *B65D 71/0011* (2013.01); *B65D 25/28* (2013.01)

USPC ..... 211/74; 211/49.1; 211/194

(58) Field of Classification Search

CPC .... A47B 73/00; A47B 81/007; A47B 73/006; A47B 73/008; A47B 73/002; A47F 3/18; A47F 5/02; A47F 7/28; A47F 7/281; A47F 7/283; A47J 47/16; A47G 23/02; A47G 23/0241; A47G 23/0266; B01L 9/06; B65D 1/00; B65D 23/00; B65D 23/10; B65D 23/102; B65D 23/104; B65D 1/02; B65D 25/28; B65D 25/2835; B65D 25/2838; B65D 1/12; B65D 1/14; B65D 1/16; B65D 25/2844; B65D 25/2852; B65D 5/46; B65D 5/46008; B65D 5/46072; B65D 25/2861; B65D 25/2882; B65D 71/003; B65D 71/50; B65D 71/011; B65D 25/2879; B65D 71/504; B65D 85/305; B65D 71/0018; B65D 71/0025; B65D 5/22; B65D 7/26; B65D 5/46024; B65D 71/08; B65D 71/246; B65D 71/004; B65D 71/044; B65D 21/0213; B65D 1/243; B65D 71/0059; B65D 71/0074; B65D 71/0081; B65D 71/007; B65D 71/0055

USPC ..... 211/74, 75, 49.1, 194, 183, 85.18, 175, 211/13.1; 206/141, 142, 163, 164, 166; 220/503, 507, 759, 760, 761, 763, 769, 220/770, 722

See application file for complete search history.

(56) References Cited

U.S. PATENT DOCUMENTS

| | | | | |
|---|---|---|---|---|
| 112,955 | A * | 3/1871 | Pinckney | 206/142 |
| 2,256,451 | A * | 9/1941 | Hamilton | 206/142 |

(Continued)

*Primary Examiner* — Jennifer E Novosad

(74) *Attorney, Agent, or Firm* — Christine Flanagan

(57) ABSTRACT

The portable beverage rack of the present invention is a generally square or rectangular receptacle which may safely store one or more bottles in u-shaped channels which cradle the bottles and prevent movement of the bottles while in transit or while travelling on a boat or an RV. The u-shaped channels may contain a rubber pad on the inside surface to prevent sliding, rolling or other lateral movement of the bottles. The portable beverage rack also contains a securement mechanism, such as a strap, buckle or band which extends over the top of the bottles to prevent vertical movement of the bottles. Additionally, the rack includes means to attach the rack to a wall or other vertical surface using a separate wall mounted base plate.

12 Claims, 4 Drawing Sheets

(56) References Cited

U.S. PATENT DOCUMENTS

| | | | | | |
|---|---|---|---|---|---|
| 2,259,667 | A | * | 10/1941 | Smith | 206/142 |
| 2,329,656 | A | * | 9/1943 | Sedgwick | 206/427 |
| 2,333,757 | A | * | 11/1943 | Whitaker | 206/142 |
| 2,353,846 | A | * | 7/1944 | Power | 220/6 |
| 2,395,601 | A | * | 2/1946 | Wenthe | 206/163 |
| 2,396,003 | A | * | 3/1946 | Goldman | 220/511 |
| 2,399,893 | A | * | 5/1946 | Scholz | 206/142 |
| 2,404,699 | A | * | 7/1946 | Edgerton | 206/174 |
| 2,414,708 | A | * | 1/1947 | Bassichis | 206/174 |
| 2,419,413 | A | * | 4/1947 | McCalla | 206/142 |
| 2,420,006 | A | * | 5/1947 | O'Hare | 206/163 |
| 2,425,401 | A | * | 8/1947 | Shaw et al. | 206/201 |
| 2,431,713 | A | * | 12/1947 | Stigler | 206/163 |
| 2,443,967 | A | * | 6/1948 | Smith | 206/163 |
| 2,458,133 | A | * | 1/1949 | Behrens | 206/164 |
| 2,467,106 | A | * | 4/1949 | Adkins | 206/168 |
| 2,494,303 | A | * | 1/1950 | McGuire | 206/435 |
| 2,502,690 | A | * | 4/1950 | Acton | 206/163 |
| 2,503,544 | A | * | 4/1950 | Clore | 206/435 |
| 2,508,062 | A | * | 5/1950 | Fowler | 206/142 |
| 2,508,943 | A | * | 5/1950 | Hall et al. | 206/164 |
| 2,522,978 | A | * | 9/1950 | Acton | 206/163 |
| 2,525,633 | A | * | 10/1950 | Arnett | 206/163 |
| 2,531,092 | A | * | 11/1950 | Waller | 206/435 |
| 2,532,446 | A | * | 12/1950 | Hall | 206/190 |
| 2,535,113 | A | * | 12/1950 | Acton | 206/199 |
| 2,540,068 | A | * | 1/1951 | Williamson | 16/443 |
| 2,542,365 | A | * | 2/1951 | Schumann | 206/164 |
| 2,552,361 | A | * | 5/1951 | Acton | 206/164 |
| 2,593,861 | A | * | 4/1952 | Eder et al. | 220/516 |
| 2,603,377 | A | * | 7/1952 | Mayers et al. | 217/19 |
| 2,606,703 | A | * | 8/1952 | Olson | 206/164 |
| 2,624,498 | A | * | 1/1953 | Lamprecht | 206/164 |
| 2,632,595 | A | * | 3/1953 | Finkbone | 229/117.22 |
| 2,667,995 | A | * | 2/1954 | Bruce et al. | 206/160 |
| 2,682,972 | A | * | 7/1954 | Ringler | 206/164 |
| 2,731,169 | A | * | 1/1956 | Wahlbom | 206/196 |
| 2,916,185 | A | * | 12/1959 | Skulavik | 206/174 |
| 2,954,899 | A | * | 10/1960 | Skulavik | 206/174 |
| 2,997,169 | A | * | 8/1961 | Poupitch | 206/150 |
| 3,016,136 | A | * | 1/1962 | Poupitch | 206/527 |
| 3,261,498 | A | * | 7/1966 | Erickson | 206/164 |
| 3,362,577 | A | * | 1/1968 | Singer et al. | 206/164 |
| 3,531,014 | A | * | 9/1970 | Lane | 206/203 |
| D222,151 | S | * | 10/1971 | Majewski | D7/701 |
| D233,878 | S | * | 12/1974 | Berger et al. | D7/600.4 |
| 3,951,259 | A | * | 4/1976 | Oglesbee | 206/164 |
| 3,966,103 | A | * | 6/1976 | Abrams | 294/144 |
| 4,093,076 | A | * | 6/1978 | Newton | 211/74 |
| 4,494,788 | A | | 1/1985 | Altemose | |
| 4,884,683 | A | * | 12/1989 | Ford | 206/163 |
| 5,078,155 | A | * | 1/1992 | Grandel | 131/231 |
| 5,150,784 | A | | 9/1992 | Sayad | |
| 6,135,297 | A | * | 10/2000 | DeShazo et al. | 211/74 |
| 6,290,074 | B1 | * | 9/2001 | Syvuk et al. | 211/74 |
| 6,615,996 | B1 | | 9/2003 | Ivey | |
| 6,769,659 | B1 | * | 8/2004 | Martello | 248/311.2 |
| 6,811,042 | B2 | * | 11/2004 | Kelly et al. | 211/74 |
| 7,048,130 | B2 | * | 5/2006 | Hurst | 211/74 |
| 2001/0025824 | A1 | * | 10/2001 | Olivero | 211/74 |
| 2002/0036178 | A1 | * | 3/2002 | Tombu | 211/74 |
| 2006/0261019 | A1 | * | 11/2006 | Chao et al. | 211/74 |
| 2007/0108143 | A1 | * | 5/2007 | Kilduff | 211/74 |
| 2007/0108144 | A1 | * | 5/2007 | Flick | 211/74 |

* cited by examiner

SECURE STOW GO WINE RACK

RELATED APPLICATIONS

This application claims priority to U.S. Provisional Patent Application No. 61/463,647 filed on Feb. 22, 2011, which is incorporated herein by reference in its entirety

FIELD OF THE INVENTION

The present invention is directed to a portable rack for securely holding breakable beverage bottles.

BACKGROUND OF THE INVENTION

Beverage bottles, such as wine bottles are typically carried in a paper bags or other shopping bags. However, due to the fragile nature of the glass and the potential for having to transport two or more bottles, these transport modes are unsafe. Two or more wine bottles become difficult to safely transport from one location to another considering the weight and breakability of glass bottles. It is fairly common for one to take or transport wine or other beverages to a party, on a trip or while traveling in an RV, boat or other moving vehicle.

Various wine carriers are known in the art. These carriers are generally wire framed baskets which hold the bottles in an upright position or wooden carriers with little or no protection. Also, once the carrier has reached its destination, placing such carriers on the table or floor is not ideal when travelling in moving vehicles such as RVs or boats. The bottles may vibrate against one another or may roll or otherwise move, coming in contact with other bottles or inflexible items.

There is a need in the art for a safe and secure device for transporting wine from one place to another and also for storing the bottles while travelling in a moving vehicle such as an RV or boat.

SUMMARY OF THE INVENTION

The portable beverage rack of the present invention is a generally square or rectangular receptacle which may safely store one or more bottles in u-shaped channels which cradle the bottles and prevent movement of the bottles while in transit or while travelling on a boat or an RV. The u-shaped channels may contain a rubber pad on the inside surface to prevent sliding, rolling or other lateral movement of the bottles. The portable beverage rack also contains a securement mechanism, such as a strap, buckle or band which extends over the top of the bottles to prevent vertical movement of the bottles. Additionally, the rack includes means to attach the rack to a wall or other vertical surface using a separate wall mounted base plate.

DETAILED DESCRIPTION OF PREFERRED AND ALTERNATE EMBODIMENTS

Figure 1:
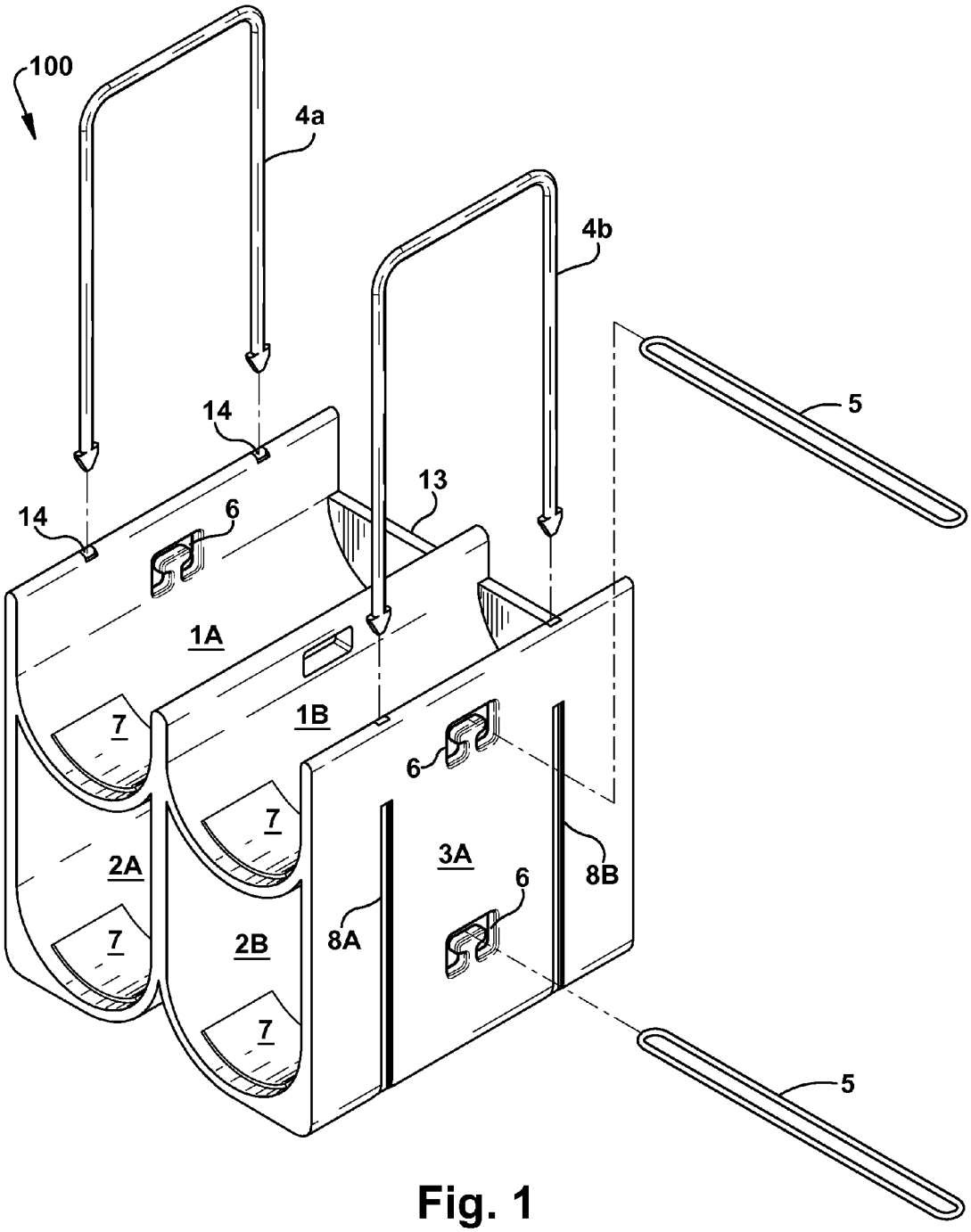
FIG. 1 is an exploded perspective view of the portable wine rack of the present invention.

The portable wine or beverage rack (hereinafter referred to interchangeably as "rack"; "wine rack"; "portable wine rack"; "beverage rack") of the present disclosure and related inventions is a novel storage and transport mechanism which provides for the safe and secure movement of wine or other such glass beverage bottles from one location to another. As used herein the term "bottle" refers generally to a standard size wine or champagne bottle, generally having a width ranging from approximately 2⅜-inches to approximately 4 inches. However, the portable beverage or bottle rack may be made to fit specific or specially-sized bottles.

In a preferred embodiment, as described herein and shown in the figures, the portable wine rack 100 can accommodate up to four bottles, two bottles located in an adjacent manner on a first tier and two bottles located in an adjacent manner on a second tier. The second tier is vertically spaced apart from and located directly above the first tier. Each tier contains two u-shaped channels which each hold or cradle a single bottle placed on its side in a horizontal manner. The two u-shaped channels 1A, 1B on the first or bottom tier contain side walls that extend vertically upward and are contiguous with the two u-shaped channels 2A, 2B on the second or top tier. The two u-shaped channels 2A, 2B on the second or top tier continue to extend vertically upward, reaching a point above the top of a horizontally placed bottle as placed within a channel. The right 3A and left 3B side walls of the rack 100 are substantially planar but may, in certain embodiments, contain slots or openings thereon to facilitate securement of the bottles to the rack 100 via an attachment mechanism. The right 3A and left 3B side walls of the rack 100 may also contain openings thereon to facilitate attachment of the entire rack to a wall or other vertical surface, as discussed in detail below. In one embodiment, the left and right sides of the rack may also contain hollowed elongate openings 8A, 8B into which retractable handles 4A, 4B may be stored. Otherwise, the handles may be simply attached to the top of both the right 3A and left 3B sides of the rack 100. The handles 4A, 4B may be rotatable about the top of the right 3A and left 3B side walls of the rack 100 such that they may be moved towards one another to facilitate a user gripping both handles 4A, 4B in one hand for pick-up and/or transport. The back or rear face 13 of the rack 100 is also substantially planar but may contain, as discussed above with respect to the right 3A and left 3B walls of the rack 100, optional slots or openings thereon to accommodate attachment of the rack 100 to a separate wall mount plate 10 for securing the rack 100 to a wall or other vertical surface. The front face of the rack is substantially open to accommodate bottles in a side or horizontal position with the top or neck of the bottle or bottles extending outward. The rack 100 is preferably made of molded plastic, but other suitable materials may be used. Each of the u-shaped channels 1A, 1B, 2A, 2B may contain a sheet of adhesive backed rubber 7 to create a friction grip on each of the bottles placed therein to prevent movement or sliding of the bottles along the channel when the rack 100 is in motion. While the portable wine rack 100 has been described herein and shown in the figures as accommodating four bottles, nothing in this disclosure is meant to limit the invention in any way and a wider or taller rack which may accommodate more than four bottles has been contemplated and is considered to be within the scope of this invention.

The rack 100 contains one or more securement mechanisms which are operative to securely hold the bottles in place within each of the u-shaped channels 1A, 1B, 2A, 2B. As used herein the term "securement mechanism" refers to any device which secures a bottle to the portable bottle rack during movement of the rack. The securement mechanism can take a variety of forms. In one embodiment, shown in FIG. 3, one or more rubber bands 5 may be used to secure the bottles within the rack 100. The rubber band 5 may be stretched from the right side wall 3A of the rack 100 to the left side wall 3B of the rack 100 slightly above or directly on top of the bottles contained in the two adjacent u-shaped channels 1A, 1B, 2A, 2B on each of the two tiers of the rack 100. The right 3A and left 3B side walls of the rack 100 may contain openings 6 thereon with t-cleats (as shown in the FIGS. 1-3) to secure each side of the rubber band 5 in place across the top surface of the horizontally placed bottles. Other such mechanisms can be used in place of the t-cleats to hold the rubber bands 5 in place. At least one rubber band 5 may be used across the first or bottom tier and at least one rubber band 5 may be used across the second or upper tier. Alternately, in another embodiment, shown in FIG. 4, a band or strip of material 12 may extend across each tier above the bottles placed in the u-shaped channels 1A, 1B, 2A, 2B, the material having a reinforced loop patch (such as a Velcro™ loop patch) sewn or otherwise attached to the bottom or downward facing surface thereof. The material 12 may extend from the right side 3A to the left side 3B of the rack 100 and beyond. A small hook patch (such as a Velcro™ hook patch) 15 may be attached, adhesively or otherwise, to the outer surface of the right 3A and left 3B sides of the rack 100. At least one band or strip of material 12 with the loop patch extends across each tier with each of the distal ends inserted into openings 16 on the right 3A and left 3B side walls of the rack 100 and attached to the hook patch 15 such that the band or strip of material 12 is held taught across the top surface of the bottles lying horizontally within each u-shaped channel 1A, 1B, 2A, 2B. In still another embodiment, two straps may be attached the top of opposite sides of each u-shaped channel. One of the straps may contain a buckle, a button, a snap or other such attachment mechanism to secure one strap to the other opposite strap to secure each bottle into each of the u-shaped channels. While the securement mechanisms described herein and shown in the figures are straps or rubber bands, any other type of securement mechanism may be used and other mechanisms have been contemplated and are considered to be within the scope of this invention.

Figure 2:
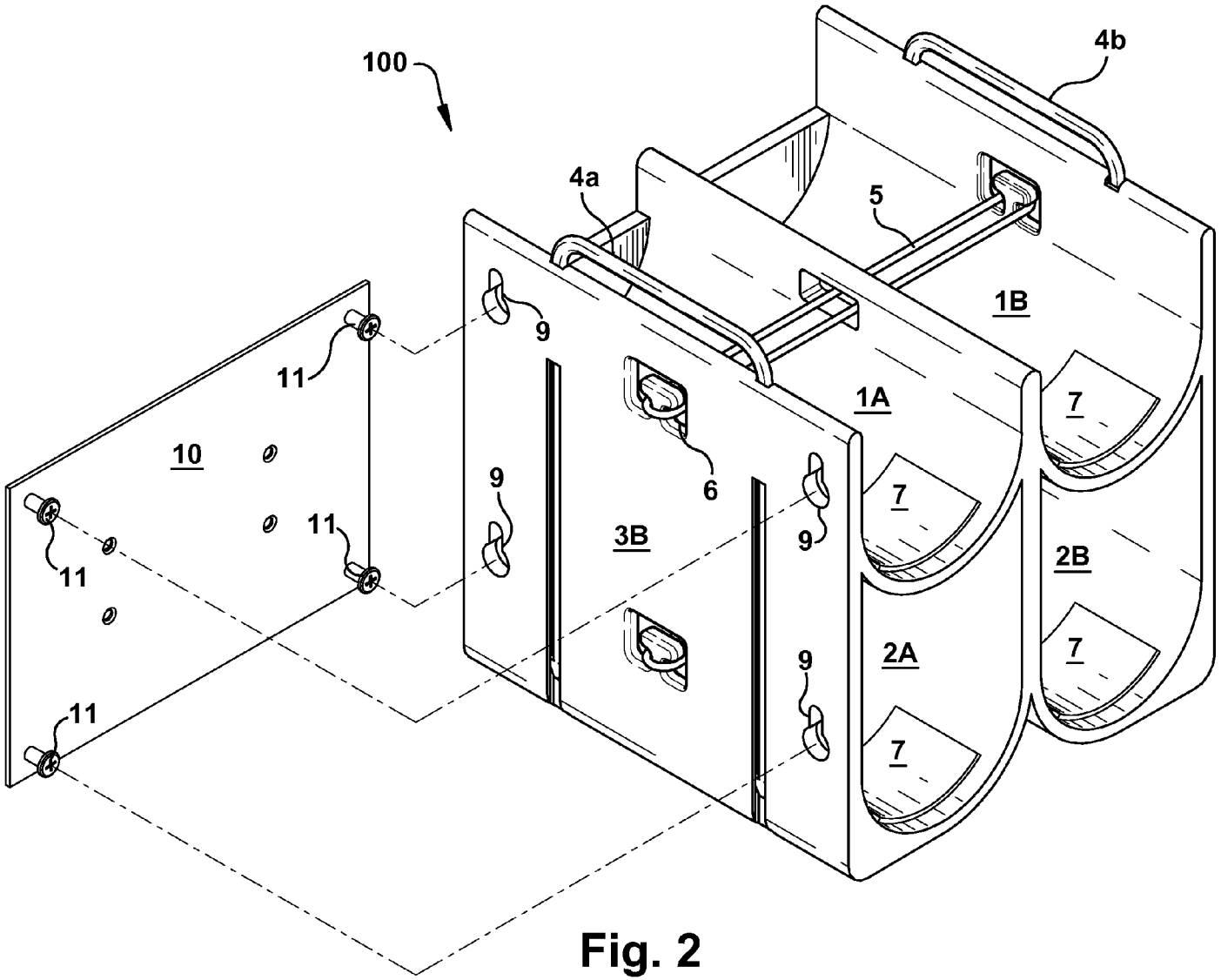
FIG. 2 is a perspective view of the portable wine rack and wall mounted base plate.
Figure 3:
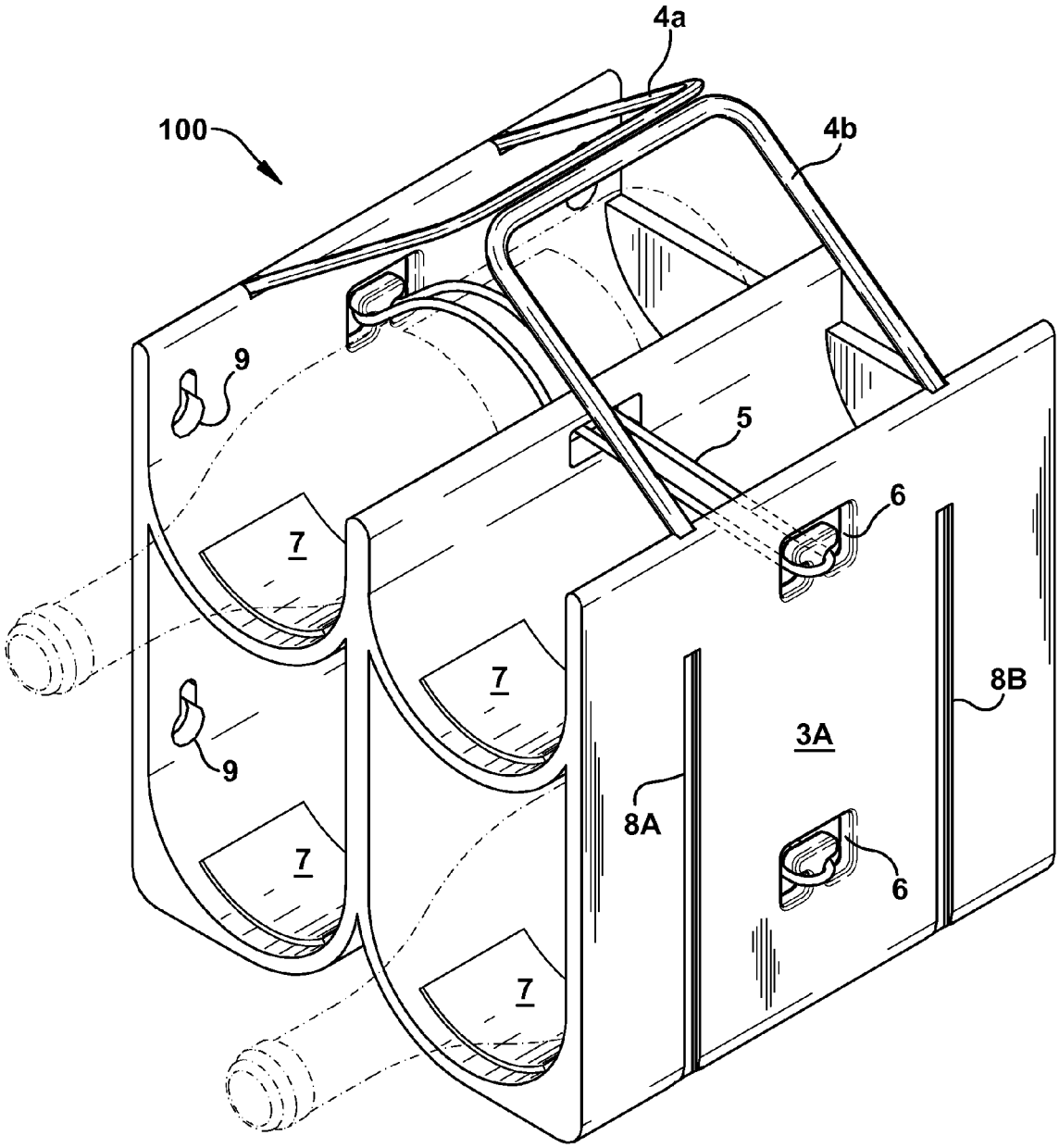
FIG. 3 is a perspective view of the portable wine rack with protracted handles and rubber band securement mechanism.
Figure 4:
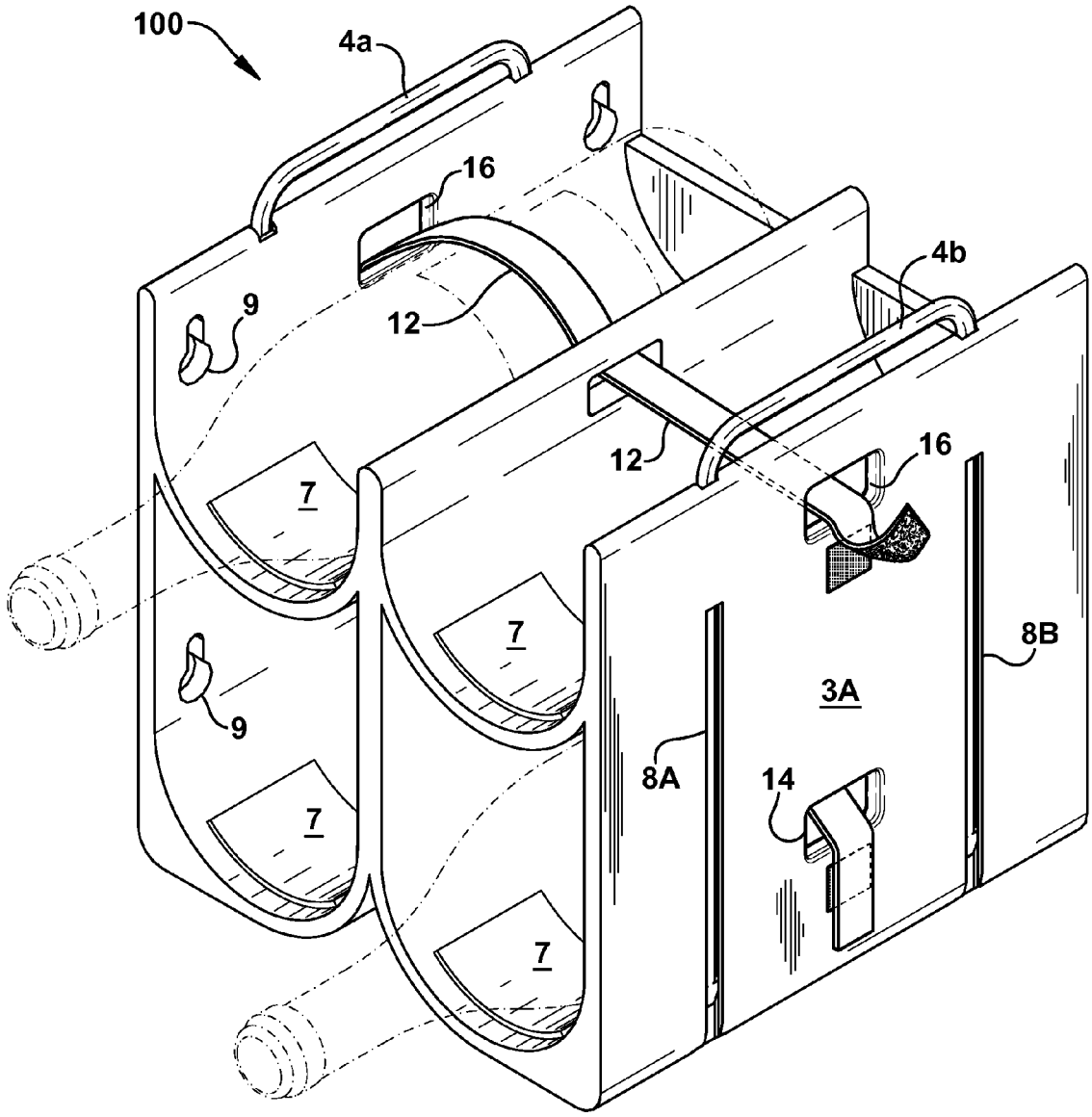
FIG. 4 is a perspective view of the portable wine rack with retracted handles and Velcro™ strip securement mechanism

As mentioned above, the portable wine rack 100 of the present invention contains one or more handles which are used to pick-up and carry or transport the rack. Various types of handles may be used with the present invention. In a preferred embodiment, one inverted u-shaped handle 4 is attached or inserted into the right 3A and the left 3B side walls of the wine rack 100. The distal ends of each handle are shaped like an arrow-head so that once the handles 4 are inserted into the sides 3A, 3B of the wine rack 100, they cannot be completely removed therefrom. Two hollow channels or cavities 8A, 8B exist in each of the right 3A and left 3B side walls of the rack 100, to accommodate each leg of the handle 4. The legs of each handle 4 may have a longer length than that of the wine rack 100, such that when the handle 4 is in a resting position, with each leg substantially within the right 3A and left 3B side walls of the rack 100, the handle 4 extends above the rack 100, as shown in FIG. 2, for easy gripping of each handle 4. Once a user is ready to pick-up or carry the rack 100, each handle 4 may be lifted out from the side walls 3A, 3B of the rack 100. Each handle 4 extends upward until the two arrow-head ends of each leg of each handle 4 are reached. The openings 14 atop each of the right 3A and left 3B side walls of the wine rack 100 are angled such that each handle 4 may come together in an A-shape where the tops or the gripping portion of each handle 4 are in contact with one another, as shown in FIG. 3. In alternate embodiment, the handles may not retract or slide back into the channels in the side walls of the rack but may simply be attached to the top surface of the right 3A and left 3B side walls. The handles 4 may be made of plastic, metal, wood, or any other suitable material. While a single handle 4 has been described herein and shown in the figures as being located on each of the right 3A and left 3B side walls of the rack 100, any number of handles may be used and various positions and locations for the handles 4 have been contemplated and are considered to be within the scope of this invention.

The entire portable wine rack 100 of the present invention may be attached to a wall or other vertical structure, such as a boat or an RV, to secure the structure while in motion. As mentioned above, one side 3A or 3B of the rack 100 may contain openings 9 thereon which facilitate attachment of the rack 100 to a wall mounted base plate 10, as shown in FIG. 2. The wall mounted base plate 10 is a substantially planar sheet having various apertures or holes contained thereon. In a preferred embodiment, threaded apertures or holes are contained proximate to each corner of the square or rectangular shaped base plate 10. Screws 11 are inserted into the threaded holes and extend in an outward direction to facilitate attachment of the wine rack 100 thereto. One side, right 3A or left 3B, of the wine rack 100 contains four apertures or holes 9 which correspond to the location of the four screws 11 contained on the base plate 10. The apertures or holes 9 contained on the rack 100 may be pear shaped, as shown in FIG. 2, for easy attachment and removal of the rack 100 from the base plate 10 and to further secure the rack 100 to the base plate 10 when attached. The base plate 10 may be made of metal, wood, plastic, or any other suitable material.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. A portable bottle rack comprising:

a right side wall, a left side wall, which is parallel to and spaced apart and opposite from the right side wall and a back wall, which extends perpendicularly between the right and left side walls;

a first tier located between the right and left side walls and parallel to the back wall, the first tier having at least one open-topped u-shaped channel;

a second tier spaced apart from and directly above the first tier, between the right and left side walls and parallel to the back wall, the second tier having at least one open topped u-shaped channel;

a first retractable handle which is slidably attached to the right side wall;

a second retractable handle which is slidably attached to the left side wall;

a securement mechanism operative to secure at least one bottle lying horizontally within the at least one u-shaped channel on the first or second tier, the securement mechanism only coming into direct contact with the at least one bottle along a side surface thereof;

wherein the first and second tiers are dimensioned to accommodate at least one bottle within the at least one u-shaped channel.

2. The portable bottle rack of claim 1, wherein the first and second tiers each contain two u-shaped channels for storing one or more bottles therein.

3. The portable bottle rack of claim 1, wherein the first and second retractable handles pivot in an inward direction.

4. The portable bottle rack of claim 1, wherein the securement mechanism comprises a fabric hook patch attached to the right and left side walls and an elongate fabric loop patch which extends over the first and second tiers and attaches to the fabric hook patch.

5. The portable bottle rack of claim 1 further comprising a wall mount base plate located parallel and proximate to the back wall, which is operative to secure the portable bottle rack to a wall.

6. A portable bottle rack comprising:

a right side wall;

a left side wall spaced apart from and parallel to the right side wall;

a back wall which extends horizontally between the right and left side walls;

a first tier extending between the right and second side walls, the first tier having two u-shaped channels contained therein;

a second tier extending between the right and second side walls and directly below the first tier, the second tier having two u-shaped channels contained therein;

a first strap having at least one side which is covered by a fabric loop patch;

a first handle having a first position wherein the first handle is substantially enclosed within at least one cavity located in the right side wall and a second position wherein the first handle is substantially removed from the at least one cavity located in the right side wall;

a second handle having a first position wherein the second handle is substantially enclosed within at least one cavity located in the left side wall and a second position wherein the second handle is substantially removed from the at least one cavity located in the left side wall;

the right and left side walls each having at least two openings therein and at least two fabric hook patches, each of the at least two fabric hook patches located below and proximate to the at least two openings.

7. The portable bottle rack of claim 6, wherein the two u-shaped channels located on the first and second tiers are coated with rubber.

8. The portable bottle rack of claim 6, wherein the first handle is pivotable about the right side wall when it is in the second position and the second handle is pivotable about the left side wall when it is in the second position.

9. The portable bottle rack of claim 6 further comprising at least two additional apertures located in the right or left side walls to facilitate attachment of the portable bottle rack to a mounted base plate.

10. The portable bottle rack of claim 6, wherein the first and second handles cannot be completely removed from the right and left side walls.

11. The portable bottle rack of claim 6, wherein the portable bottle rack is made of molded plastic.

12. The portable bottle rack of claim 6, wherein each of the two u-shaped channels located on the first and second tiers can accommodate a wine bottle.

* * * * *